US008707502B2

(12) United States Patent
Arledge et al.

(10) Patent No.: US 8,707,502 B2
(45) Date of Patent: Apr. 29, 2014

(54) GOLF EQUIPMENT CLEANING DEVICE AND METHOD OF USE

(71) Applicants: Craig J. Arledge, Lubbock, TX (US); Simon J. Key, Red Bank, NJ (US)

(72) Inventors: Craig J. Arledge, Lubbock, TX (US); Simon J. Key, Red Bank, NJ (US)

( * ) Notice: Subject to any disclaimer, the term of this patent is extended or adjusted under 35 U.S.C. 154(b) by 0 days.

(21) Appl. No.: 13/849,779

(22) Filed: Mar. 25, 2013

(65) Prior Publication Data

US 2013/0212824 A1 Aug. 22, 2013

Related U.S. Application Data

(63) Continuation-in-part of application No. 12/912,973, filed on Oct. 27, 2010, now Pat. No. 8,413,287.

(60) Provisional application No. 61/256,598, filed on Oct. 30, 2009.

(51) Int. Cl.

| | |
|---|---|
| ***A63B 57/00*** | (2006.01) |
| ***A46B 15/00*** | (2006.01) |
| *A46B 13/00* | (2006.01) |

(52) U.S. Cl.

USPC ..... 15/160; 15/161; 15/246; 301/37.41

(58) Field of Classification Search

USPC ..... 15/160, 161, 246, 88.4, 49.1, 41.1, 42, 15/21.1, 176.1–176.6, 202, 104.92, 205.2; 301/37.41, 37.102, 37.106, 37.107, 301/37.101, 37.34, 37.108, 37.109; 401/9, 401/11

See application file for complete search history.

(56) References Cited

U.S. PATENT DOCUMENTS

| | | | | |
|---|---|---|---|---|
| 2,876,473 | A * | 3/1959 | Fox | 15/21.2 |
| 5,339,486 | A * | 8/1994 | Persic, Jr. | 15/244.1 |
| 7,303,240 | B2 * | 12/2007 | Lin | 301/37.32 |

* cited by examiner

*Primary Examiner* — Mark Spisich
*Assistant Examiner* — Andrew A Horton
(74) *Attorney, Agent, or Firm* — Sarah Hegi Simpson; McWhorter, Cobb & Johnson, LLP

(57) ABSTRACT

A cleaning device for golf equipment that is attachable to a wheel is disclosed. The device generally comprises a cleaning support surface for attachment of one or more cleaning accessories. The cleaning support surface is formed in a substantially bowl shape, having a front surface and an opening in place of a rear surface. A perimeter edge is formed along the bottom edge of the cleaning support surface. The perimeter edge includes one or more attachment members for attaching the device to a wheel, such as a golf cart wheel or the like.

23 Claims, 8 Drawing Sheets

GOLF EQUIPMENT CLEANING DEVICE AND METHOD OF USE

CROSS-REFERENCE TO RELATED APPLICATIONS

This application is a continuation-in-part of U.S. patent application Ser. No. 12/912,973, filed Oct. 27, 2010 now U.S. Pat. No. 8,413,287, which is related to and claims priority from earlier filed U.S. Provisional Patent Application No. 61/256,598, filed Oct. 30, 2009. The entire contents of all earlier filed applications are incorporated herein by reference.

BACKGROUND OF THE INVENTION

1. Field of the Invention

The present invention generally relates to golf equipment and accessories. More specifically, the present invention relates to a portable device for cleaning golf equipment.

2. Description of Related Art

Despite the ever increasing availability of high-tech golfing accessories, a common problem still remains: the difficulty of maintaining clean equipment, such as golf balls, shoes, and clubs, while playing golf. Golf balls are designed to have dimpled surfaces, which accumulate dirt, sand, mud or other particulates during play. Many players wear golf shoes with cleats or spikes, which further compound the accumulation of grass, dirt, mud and debris on the shoes. Golf clubs include various parts which are prone to collecting dirt or debris, including the grip, the shaft and the club head. For example, grooves in club heads, which grip the ball during impact and impart backspin on the ball when struck, often clog with dirt or debris, rendering the grooves ineffective. Due to the playing environment and the designs utilized for golfballs, shoes and clubs, it is a constant struggle for golfers to maintain clean equipment.

It is well known in the art that clean golf clubs hit truer, clean golf balls fly straighter, and clean golf shoes provide more stability. As a result, many different devices have been developed for cleaning golf accessories and equipment. Design problems in current devices, however, present several disadvantages that are overcome by the present invention.

Many current devices require users to manually scrub equipment with a hand-held device such as a hand-held brush. Such devices may be carried on a golf bag or on a golfer's person. Golfers, however, already carry a great deal of gear and prefer not to carry additional items such as a cleaning brush. Plus, such hand-held devices are easy to misplace, ineffective for removing stubborn debris, and require users to vigorously scrub the device against the equipment to clean the equipment.

Other current devices are known which are designed to mount to personal automobiles. Since automobiles are used for many purposes other than transportation to and from the golf course, it is not practical or desirable to mount cleaning devices for golf equipment to a personal automobile. Furthermore, players need to be able to clean golf equipment while on the golf course. It would be impractical, inconvenient and time-consuming to lug dirty equipment to the player's automobile, in the golf course parking lot, for cleaning between each hole.

In the past, country clubs understood this problem and responded by installing freestanding blocks on the golf course grounds with mounted brushes for cleaning purposes. In recent years, however, many country clubs have eliminated this amenity due to the associated costs.

Still other devices are known which are designed to mount to a wheel on a golf cart. Design flaws in such devices, however, present several disadvantages. Such a device is disclosed in U.S. Pat. App. Pub. No. 2009/0152857 by Easley. Due to the configuration of Easley's device and the attachment mechanism utilized, Easley's device is difficult to attach to a wheel and even more difficult to detach from the wheel, e.g., for storage, cleaning, maintenance, or other purposes. Easley's device utilizes U-bolts, which have a threaded portion and a hook portion, along with nuts (e.g., acorn nuts, wing nuts, etc.) which are received on the threaded portion of the bolt, to attach the device to the spokes of a wheel. The U-shaped portions of the U-bolts loop around the spokes of the wheel for coupling the device to the wheel. This attachment mechanism is time-consuming, inefficient, inconvenient, and insecure. The U-bolts fail to provide the tight and secure attachment required for the cleaning device to operate effectively when mounted to a golf cart wheel. Insecure attachment to the wheel decreases the effectiveness and the cleaning power of the device and makes the device ineffective for removing stubborn debris.

Moreover, Easley's device utilizes a block, having a flat rear surface connected to a flat front surface by side surfaces, for attachment of bristles or other cleaning elements. U-bolts pass transversely through the front surface and the rear surface of the block to couple the device to the spokes of a wheel. The rear surface of Easley's device further complicates secure attachment of the device to a wheel, as the flat rear surface is disposed adjacent to the wheel hub and wheel spokes when the device is attached to a wheel. This flat rear surface must be attached to a flat surface on the wheel in order for the device to be securely attached to the wheel. However, the hub and the spokes of golf cart wheels oftentimes form an uneven surface (e.g., the hub often protrudes from the center of the wheel and the spokes often slope downwardly from where they attach to the hub to where they attach to the rim of the wheel). Therefore, the face of the wheel generally does not provide a flat surface for attaching Easley's device. As a result, the flat rear surface of Easley's device, which is disposed adjacent to the face of the wheel when the device is attached to the wheel, interferes with attachment to the many different configurations of wheels used on golf carts.

Currently, a need exists for a golf equipment cleaning device that is portable, yet does not require the golfer to carry the device on the golfer's bag or person. A cleaning device is needed that is not easily misplaced, that is effective for removing stubborn debris, and that does not require the user to vigorously scrub the device against the user's equipment to remove debris. A device is needed that can be used to clean a player's golf clubs while the player is progressing from hole to hole on a golf course. Additionally, a device is needed that is releasably attachable to a wheel on a golf cart or the like and that provides for a quick, secure, easy and convenient attachment mechanism. An attachment mechanism for such a cleaning device is needed that is able to withstand the force exerted on the device when a user rubs golf equipment against the cleaning device for removal of debris.

In view of the foregoing, it is apparent that a need exists in the art for a golf equipment cleaning device which overcomes, mitigates or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above-described drawbacks associated with current devices.

To achieve these and other advantages and in accordance with the purpose of the invention, as embodied and broadly described, the present disclosure describes a cleaning device for golf equipment that is attachable to a wheel of a golf cart or the like.

By utilizing a novel and unique configuration and attachment mechanisms, the disclosed device overcomes the drawbacks associated with current devices. The device generally comprises a cleaning support surface for attachment of one or more cleaning accessories. The cleaning support surface is formed in a substantially bowl shape, having a front surface and an opening in place of a rear surface. A perimeter edge is formed along the bottom edge of the cleaning support surface. The perimeter edge includes one or more attachment members for coupling the device to a wheel, such as a golf cart wheel.

The unique design of the cleaning support surface of the disclosed device provides many advantages over current devices. The cleaning support surface is formed in a substantially bowl shape and does not have a bottom or rear surface to complicate attachment of the device to a wheel on a golf cart or the like. The disclosed device can be securely and rigidly attached to the many different configurations of wheels used on golf carts, including wheels having a hub protruding from the center of the wheel, wheels having thin wire spokes, wheels having thick metal or plastic spokes, etc.

Unlike existing cleaning devices, the present device is designed to be easily attached to and detached from a wheel on a golf cart or the like. As a result, users do not have to carry the cleaning device; the device is not easily misplaced, lost or forgotten; the device is more effective for removing stubborn debris as it rotates in conjunction with the movement of the wheel, giving the device more cleaning power; and users are not required to vigorously work to remove debris as is sometimes required when using hand-held devices. Additionally, the device offers a practical, convenient and time-efficient solution for players to be able to clean their golf equipment while on the golf course in between holes.

A further advantage is that the disclosed device may be quickly and easily attached to and detached from a wheel using the disclosed attachment members and attachment mechanisms. Arranging the attachment members of the disclosed device on the perimeter edge of the device, allows the device to be securely fastened to a wheel and to remain rigidly attached to the wheel when the cleaning device is being used to clean golf equipment. At times, it may be desirable to use the disclosed cleaning device as a hand-held device. Current devices are not designed to be effortlessly attached to and detached from a wheel. The configuration of the disclosed device, however, allows the device to be releasably attached to a wheel. If desired, the device can be effortlessly detached from the wheel for hand-held use, storage, cleaning, maintenance, or other purposes.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and form a part of the specification, illustrate embodiments of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF ILLUSTRATIVE EMBODIMENTS

Figure 1:
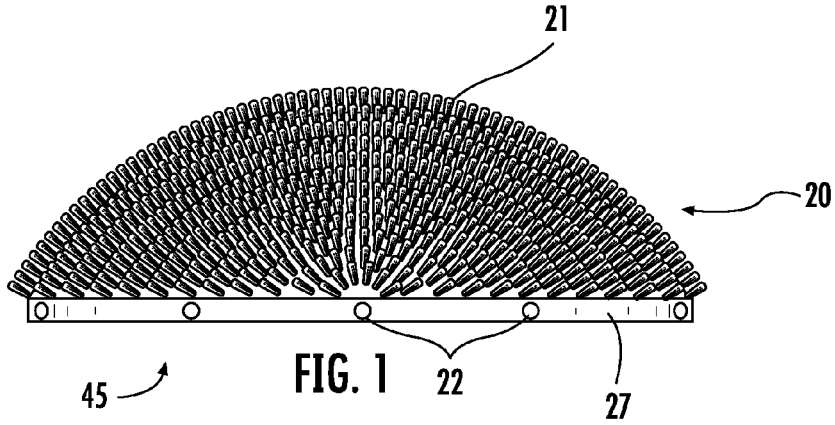
FIG. 1 is a side view of a device constructed in accordance with the teachings of the present disclosure.

Referring now to FIGS. 1-18, exemplary embodiments of a cleaning device and methods of use in accordance with the present disclosure are illustrated.

As depicted in the attached Figures, the cleaning device 20 according to the present disclosure includes a cleaning support surface 40 for attachment of one or more cleaning accessories (e.g., 21 and 28). Preferably, the cleaning support surface 40 is formed in a substantially bowl shape, having a concave front surface 41 and an opening 45 in place of a rear surface. The cleaning support surface 40 and the attached cleaning accessories must withstand the force exerted against the device 20 when a golfer holds or rubs golf equipment against the device 20 for removal of dirt or debris. Therefore, the cleaning support surface 40 may be formed of molded plastic, rubber, metal or any other material sturdy enough to support the attached cleaning accessories while the device 20 is being used to clean golf equipment.

FIGS. 8-11 show one of the embodiments of the cleaning support surface 40 contemplated by the present disclosure, wherein the cleaning support surface 40 is shown without attached cleaning accessories. In this embodiment, the cleaning support surface 40 includes a plurality of apertures along the front surface 41 thereof for attachment of cleaning accessories, such as bristles 21. The depicted embodiment further includes a recessed top surface 23 for attachment of a cleaning accessory such as a moistened sponge type accessory 28. The top surface 23 may define a rounded surface (as depicted in FIGS. 1, 1*a*, 4 and 5), a substantially flat surface (as depicted in FIGS. 2-3), a recessed surface (as depicted in FIGS. 8-13), or any other surface designed for attaching a desired cleaning accessory.

As shown in the attached Figures, the bowl-shaped cleaning support surface 40 may be configured in various manners, having curved or straight sides. In one of the embodiments contemplated by the present disclosure and depicted in FIGS. 1, 1*a*, 4 and 5, the cleaning support surface 40 is configured in the shape of a hemisphere. The circular open end 45 of the cleaning support surface 40 is configured to cover the face 44 of a wheel 24, including the hub 48 and spokes 26 of the wheel 24. This shape was found to be beneficial due to its efficient use of space, its fit on a golf cart wheel 24, and its low chances of causing or receiving damage due to its low profile and rounded configuration. Additionally, this shape provides a large surface area for attaching various types of cleaning accessories.

FIGS. 2 and 6-13 illustrate the cleaning support surface 40 configured in the shape of a modified hemisphere. In these Figures, the cleaning support surface 40 includes rounded sides for attachment of cleaning accessories, such as bristles 21, and a top surface 23 configured for attachment of a cleaning accessory, such as a moistened sponge type accessory 28.

Figure 3:
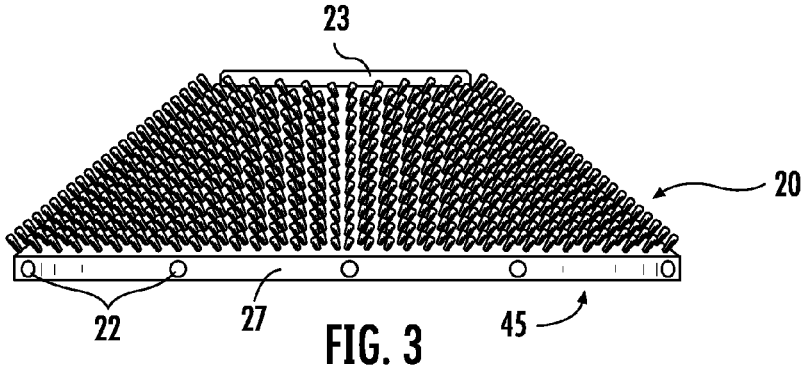
FIG. 3 is a side view of an alternative embodiment of a device constructed in accordance with the teachings of the present disclosure.

FIG. 3 illustrates the cleaning support surface 40 configured in the shape of a funnel. In this embodiment, the cleaning support surface 40 includes substantially straight sides for attachment of brush bristles 21 or other cleaning accessories. The large open end 45 of the depicted device 20 is configured to cover the face 44 of a wheel 24, and the narrower top surface 23 of the device 20 may be configured for attachment of a moistened sponge type accessory 28 or another cleaning accessory.

Although the accompanying Figures illustrate various embodiments of the cleaning support surface 40 used for attachment of one or more cleaning accessories, one skilled in the art can appreciate that there are many possibilities that exist for the configuration of the cleaning support surface, all of which are considered to be within the spirit and scope of the present invention.

FIGS. 1-7 illustrate the cleaning support surface 40 having one or more cleaning accessories attached to the exterior surface of the front surface 41 of the cleaning support surface 40. Said cleaning accessories may include devices to remove grass, dirt, sand, mud or other particulates; devices to reduce moisture or other built-up residue; or devices to shine or polish golf clubs. Such cleaning accessories may include a brush; bristles; thermoplastic nubs; dry or wet sponges, pads, foam accessories, mesh accessories or towels; or other cleaning accessories.

Figure 2:
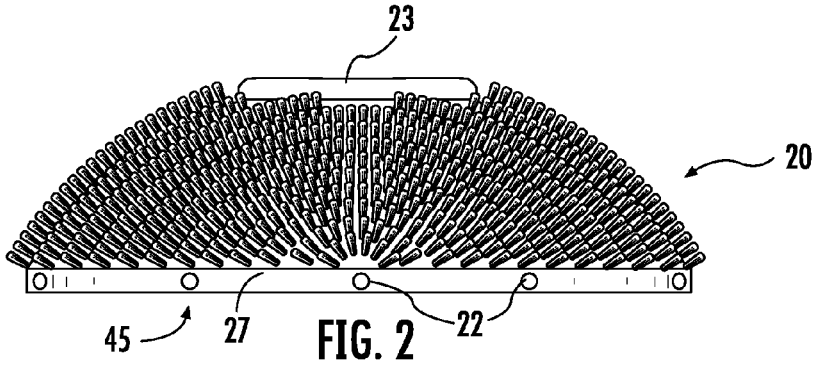
FIG. 2 is a side view of an alternative embodiment of a device constructed in accordance with the teachings of the present disclosure.
Figure 4:
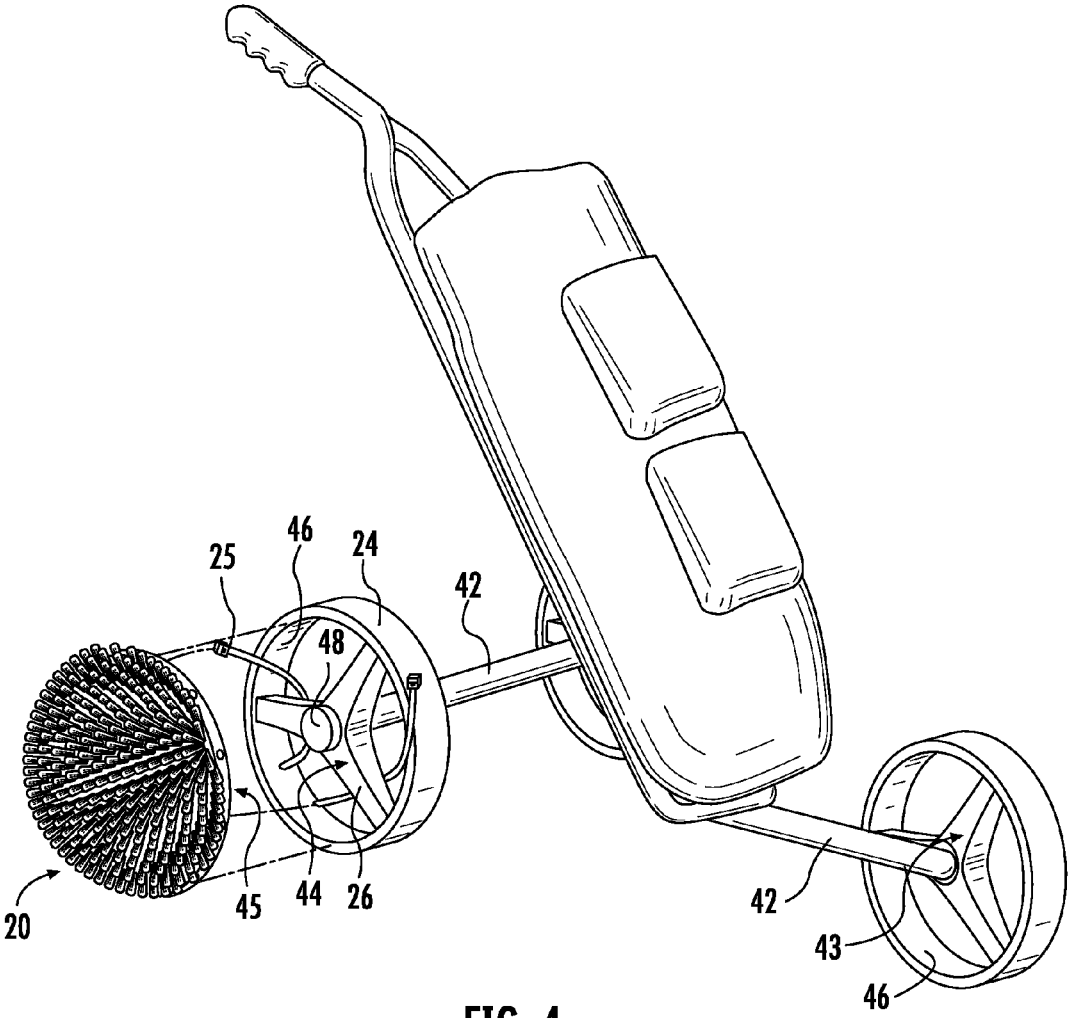
FIG. 4 is a perspective view of the device shown in FIG. 1 being attached to a wheel of a golf cart.
Figure 5:
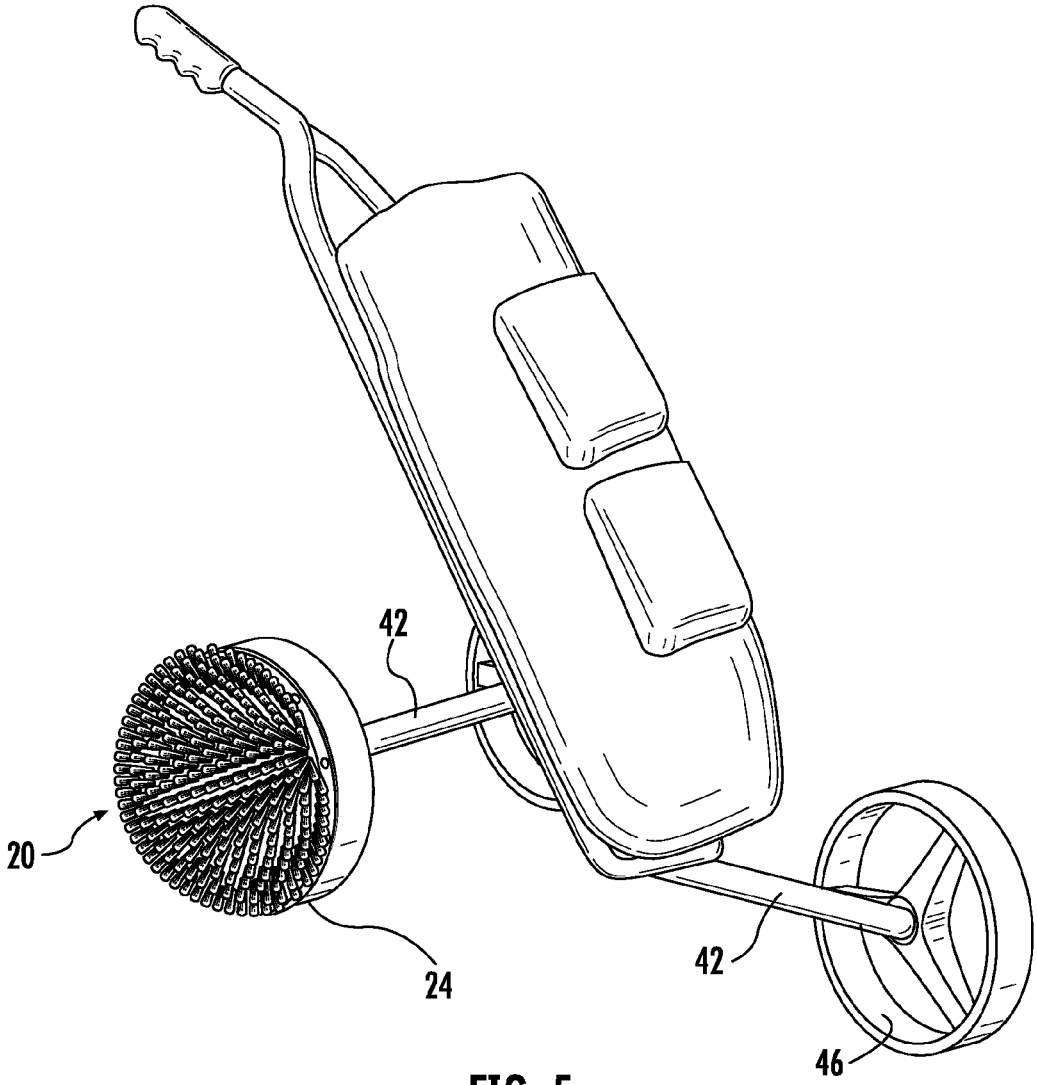
FIG. 5 is a perspective view of the device shown in FIG. 1 attached to a wheel of a golf cart.

In the embodiment shown in FIGS. 1, 4 and 5, a plurality of bristles 21 radially project from the cleaning support surface 40, forming a dome shape. When the cleaning device 20 rotates on a moving wheel 24 of a golf cart, this shape provides a uniform surface that makes it easier for a user to hold the head of a golf club against the bristles 21 as the cleaning device 20 rotates. Depending on the goals of the user and on the intended use of the device 20, it should be understood that the bristles 21 can be oriented in various directions, they can be made of any suitable synthetic or natural material, and the thickness, texture, color or configuration of the bristles are variable characteristics that are subject to change.

Figure 6:
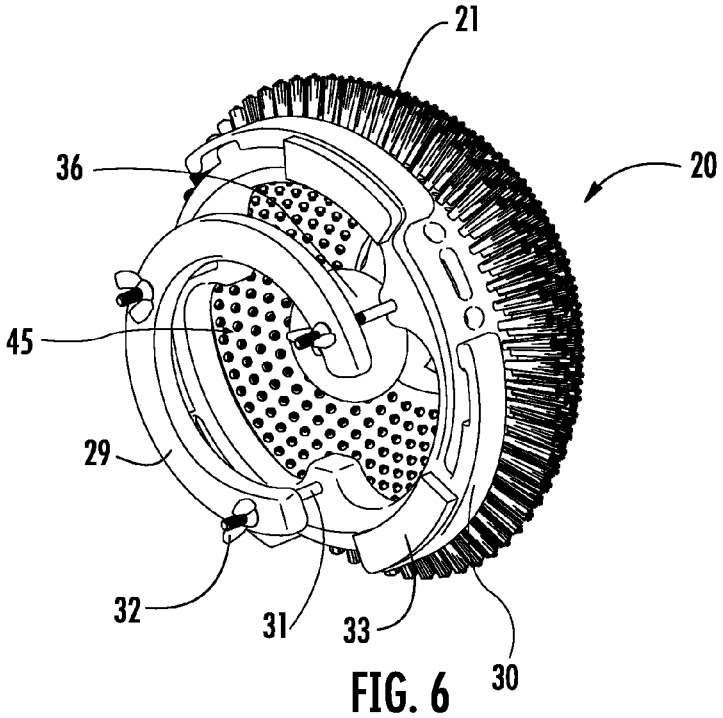
FIG. 6 is a bottom perspective view of an alternative embodiment of a device constructed in accordance with the teachings of the present disclosure.
Figure 7:
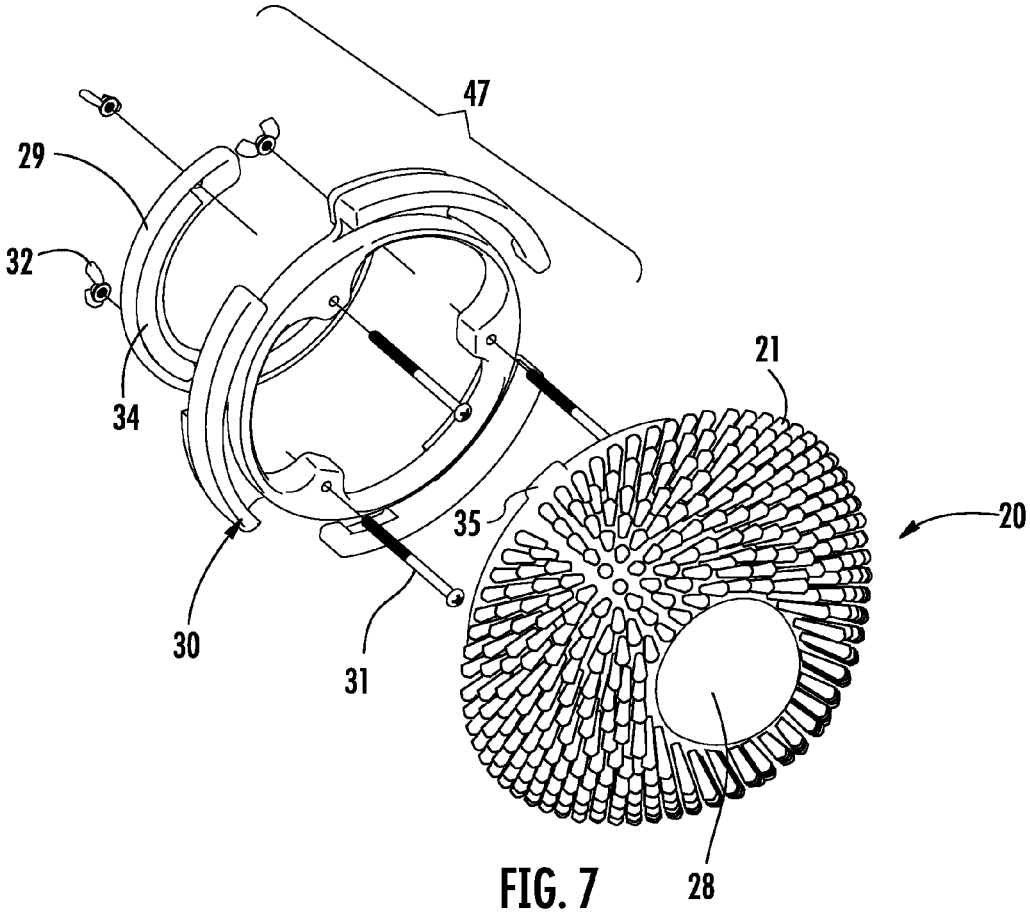
FIG. 7 is an exploded perspective view of the device shown in FIG. 6.
Figure 12:
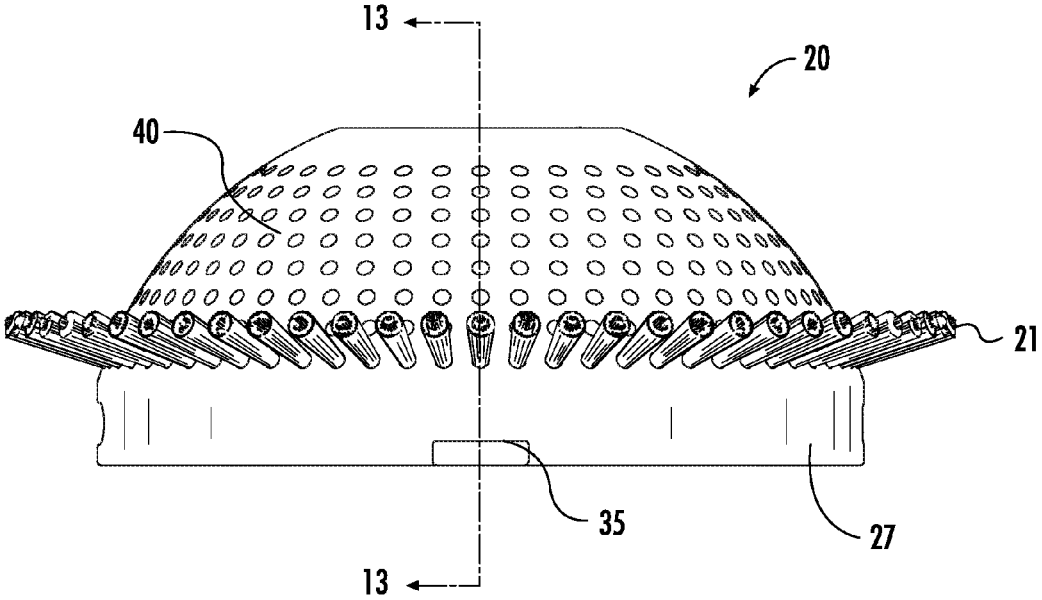
FIG. 12 is a side view of the cleaning support surface of the device shown in FIG. 6.
Figure 13:
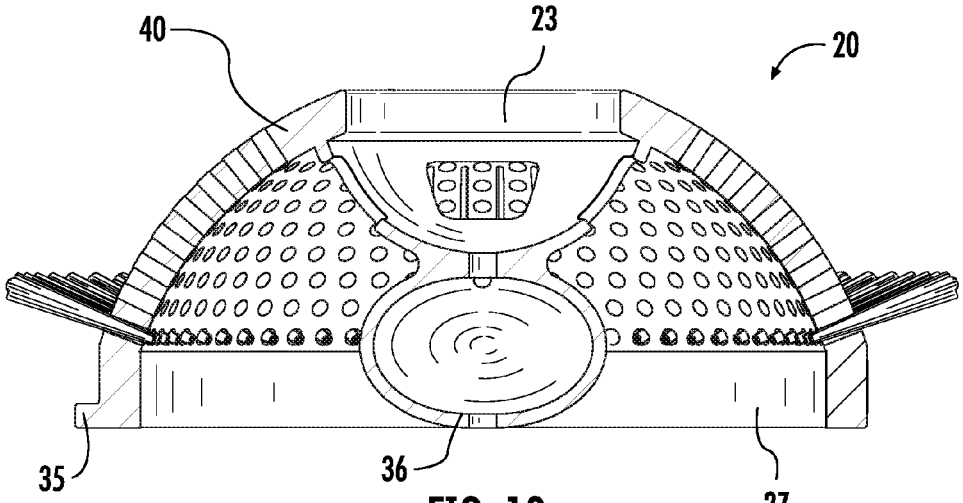
FIG. 13 is a cross-sectional view of the cleaning support surface of the device shown in FIG. 6, taken along the line 13-13 in FIG. 12.
Figure 14:
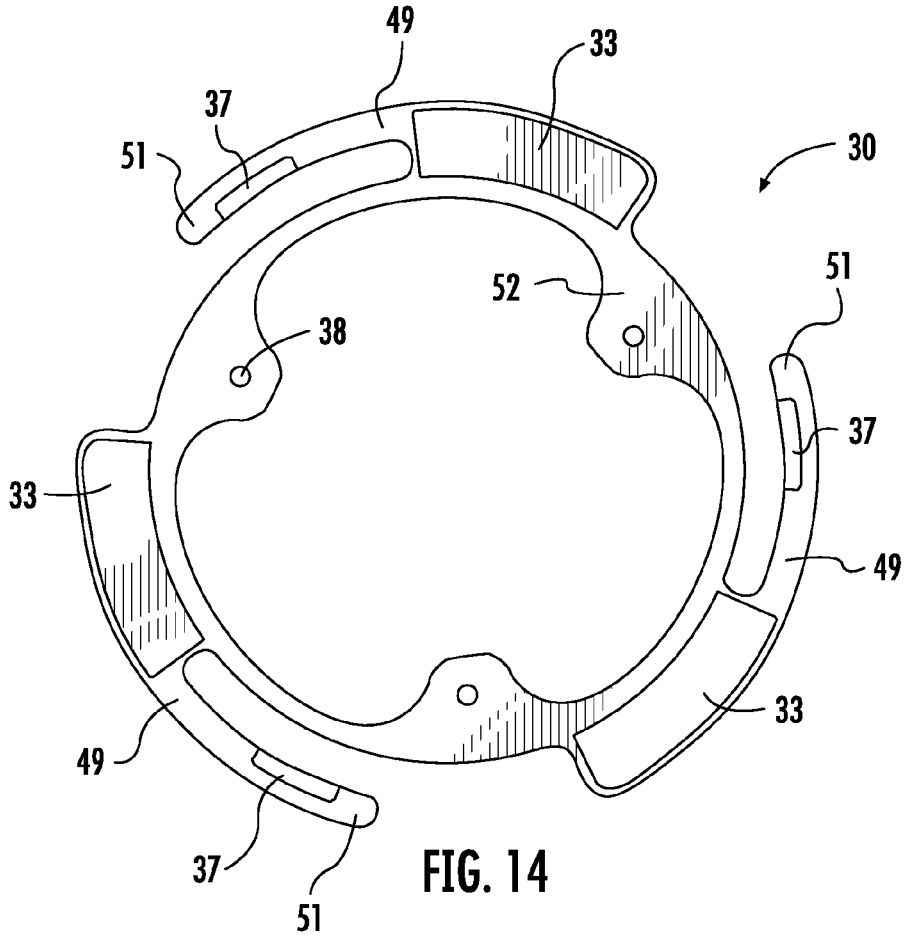
FIG. 14 is a bottom view of the locking member of the device shown in FIG. 6.
Figure 15:
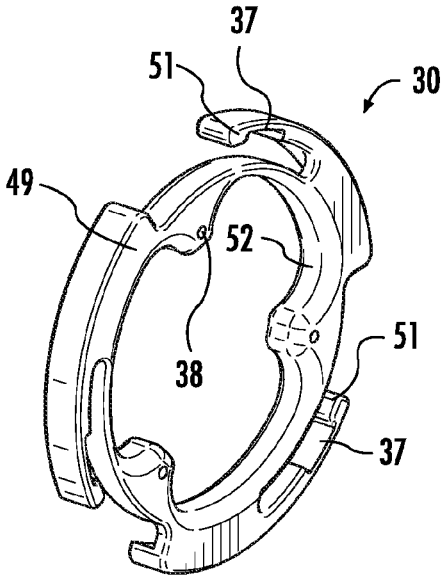
FIG. 15 is a bottom perspective view of the locking member of the device shown in FIG. 6.

In the embodiment shown in FIGS. 6-7, the bristles 21 are grouped in clusters. Arranging the bristles 21 in clusters provides a firm, reinforced, and abrasive surface to remove accumulated dirt or debris from golf equipment. In this embodiment, each bristle 21 in the cluster has an end securely embedded in the cleaning support surface 40 with an opposite end that extends away from the cleaning support surface 40 (see FIGS. 12-13, illustrating the cleaning support surface having one row of clusters of bristles secured thereto). The bristles 21 are secured to the cleaning support surface 40 using known methods and hence the various modes of attachment will not be described in detail herein. Additionally, the bristles 21 may be individually inserted into the cleaning support surface 40 instead of in clusters, and the bristles 21 can be arranged in rows or at random along the cleaning support surface 40 of the device 20.

Figure 1A:
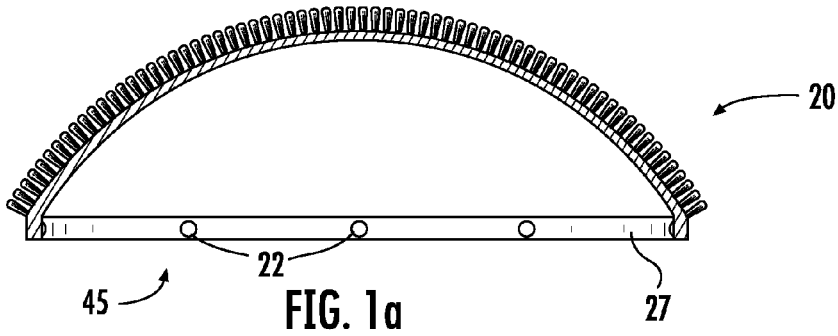
FIG. 1*a* is a side view of an alternative embodiment of a device constructed in accordance with the teachings of the present disclosure.

FIG. 1*a* illustrates an embodiment contemplated by the present disclosure wherein the cleaning support surface 40 is only partially covered by bristles 21, leaving room for attachment of various types of cleaning accessories. FIGS. 2 and 3 depict an embodiment wherein only the sides of the cleaning support surface 40 are covered by bristles 21; the top surface 23 is configured for attachment of various other cleaning accessories (e.g., dry or moistened sponges, pads, foam accessories, mesh accessories, towels, or the like). An adhesive may be utilized for attachment of various types of cleaning accessories to the cleaning support surface 40.

In one of the embodiments contemplated by the present disclosure, a liquid, such as water or a cleaning solution, may be housed below (in the orientation of the device shown in FIG. 2) a moistened sponge type accessory 28 attached to the top surface 23 of the device 20. For example, the liquid may be housed in a small reservoir or retaining lip. If the liquid is stored in a reservoir, as the wheel 24 rotates, the sponge 28 stays moistened via a passageway connecting the reservoir to the sponge 28. If a retaining lip is utilized, when the user presses golf equipment against the sponge 28, liquid from the sponge 28 is diverted to the inside of the rigid cleaning support surface 40. The retaining lip, circumscribing the inside edge of the cleaning support surface 40, catches the liquid. As the wheel 24 rotates upon movement of the golf cart, the rotation of the device 20 causes some of the water to flow back into the sponge 28, keeping the sponge 28 moistened.

Although the accompanying Figures depict various embodiments of cleaning accessories attached to the cleaning support surface 40, one skilled in the art can appreciate that numerous types of cleaning accessories can be utilized with the disclosed device 20, and thus, there are numerous embodiments that exist for arranging and attaching the cleaning accessories to the cleaning support surface 40, all of which are considered to be within the spirit and scope of the present invention.

As illustrated in the attached Figures, the cleaning support surface 40 further includes a perimeter edge 27 formed along the bottom edge of the device 20. In the embodiment depicted in FIGS. 4-5, the perimeter edge 27 of the cleaning support surface 40 is designed to fit just inside the rim 46 of a standard golf cart wheel 24. This provides the cleaning support surface 40 with maximum surface area for attachment of cleaning accessories and allows the device 20 to be securely attached to a golf cart wheel 24.

The perimeter edge 27 includes one or more attachment members (e.g., 22 and 35) for coupling the disclosed cleaning device 20 to a wheel, such as a golf cart wheel 24. In the embodiments shown in FIGS. 1-5, the attachment members are defined as one or more apertures 22, formed through the perimeter edge 27 of the device 20, for receiving fasteners 25 in order to couple the device 20 to a wheel. FIG. 4 illustrates the device 20 being attached to a golf cart wheel 24 using zip ties or cable ties. Other suitable fasteners 25 may be utilized including wire ties, Velcro, straps, screws, nuts, bolts or other suitable means for attaching the device 20 to a wheel. In FIGS. 4-5, a first end of each fastener 25 passes through an aperture 22 formed through the perimeter edge 27. The first end of the fastener 25 then passes between two spokes 26 of the wheel and loops around one or more spokes 26 before being fastened with the second end of the fastener 25.

FIGS. 6-18 illustrate an alternative embodiment of the disclosed device 20 that provides for an attachment mechanism for releasably securing the disclosed device 20 to a wheel. In the depicted embodiment, the attachment members are defined as one or more tabs 35 extending perpendicularly from the perimeter edge 27. FIGS. 6-13 show the device 20 with three tabs 35; however, other embodiments are contemplated wherein greater or lesser numbers of tabs 35 are utilized for attaching the device 20 to a wheel 24 as disclosed herein.

In this embodiment, the attachment mechanism further utilizes a mounting system 47 including a locking member 30 and a mounting member 29 for attaching the disclosed device 20 to a wheel. As illustrated in FIGS. 6-7 and 17-18, the mounting member 29 may be formed in a horseshoe configuration so that it may be easily positioned adjacent to the rear side 43 of a wheel and around the strut 42 connecting the wheel 24 to a golf cart. Alternatively, the mounting member 29 may be formed in a closed configuration, such as a closed circular configuration. In such a configuration, the wheel 24 would have to be removed from the strut assembly 42 in order to attach the mounting member 29 to the rear side 43 of the wheel, and then the wheel could be reattached to the strut assembly 42 with the mounting member 29 attached to the wheel 24.

As shown in the attached Figures, the mounting member 29 may further include one or more padded members 34 disposed between the mounting member 29 and the wheel 24 upon attachment of the mounting member 29 to the wheel 24. Such padded members 34 can be made of foam, rubber or a similar material to provide for a more secure connection of the mounting member 29 to the wheel 24.

FIGS. 6-7 and 14-16 depict an embodiment of the locking member 30, which may be coupled to the mounting member 29 to provide an attachment mechanism for the disclosed device 20. The locking member 30 is configured to attach to the face or the front side 44 of the wheel 24. The locking member 30 may be formed in an annular configuration, as depicted in the attached Figures, in order to fit around the hub 48 of the wheel 24.

As shown in the attached Figures, the locking member 30 may further include one or more padded members 33 disposed between the locking member 30 and the front side 44 of the wheel 24 when the locking member 30 is attached to the wheel 24. The padded members 33 & 34 that may be included on the mounting member 29 and the locking member 30 provide for more secure connection of the mounting system 47 to the wheel 24.

The mounting member 29 and the locking member 30 may be fastened together, with the wheel 24 positioned between the two members, using one or more fasteners 31 such as a screw, bolt, or any other suitable fastener to attach the mounting member 29 to the locking member 30. In one embodiment of the disclosed invention, each fastener 31 is received through an aperture 38 formed in the locking member 30, then passed through the spokes 26 of the wheel 24, and then finally the fastener 31 is received through an aperture 39 formed in the mounting member 29. A tightening device 32 (e.g., a wing nut, a hex nut, a dowel or an anchor screw coupled to the mounting member, etc.) may be received onto the end length of the fastener 31 to securely fasten the mounting member 29 and the locking member 30 to the wheel 24. Once the mounting member 29 and the locking member 30 are attached to the wheel 24, the disclosed cleaning device 20 can be quickly and easily attached to or detached from the mounting system 47 as further described below.

Figure 16:
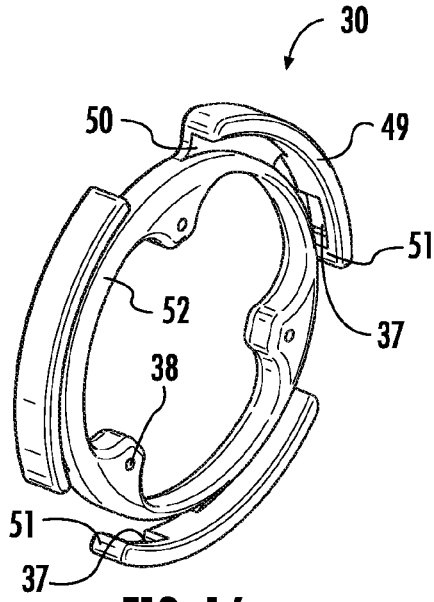
FIG. 16 is a top perspective view of the locking member of the device shown in FIG. 6.
Figure 17:
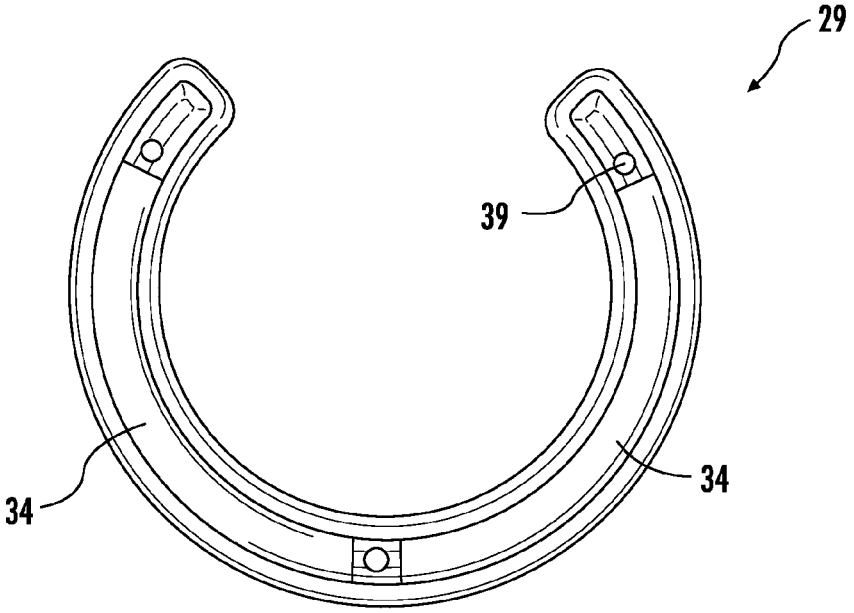
FIG. 17 is a bottom view of the mounting member of the device shown in FIG. 6.
Figure 18:
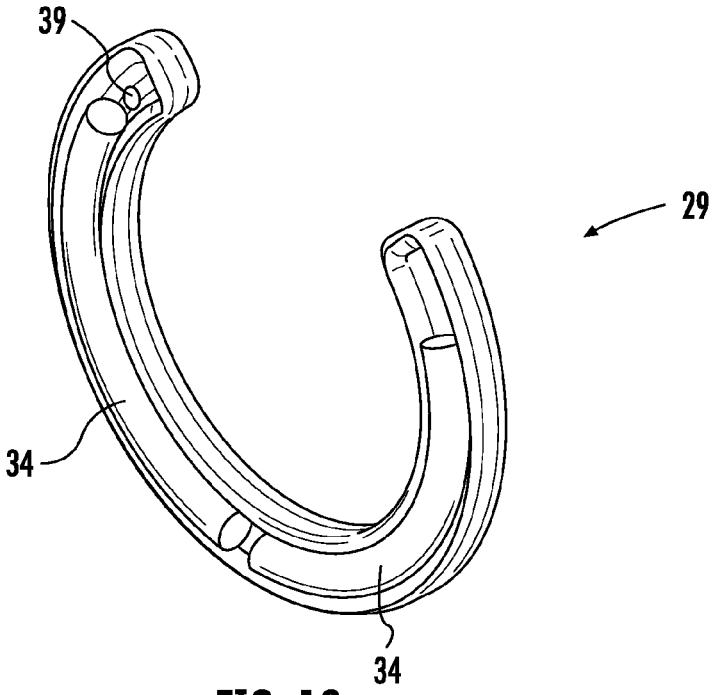
FIG. 18 is a bottom perspective view of the mounting member of the device shown in FIG. 6.

As illustrated in FIG. 16, the locking member 30 may further include one or more arms 49 attached to the body 52 of the locking member 30 via a shoulder 50. Each locking member arm 49 further includes a slot 37 and a retaining structure 51. The retaining structure 51 is located on the distal end of the arm 49. The tabs 35 of the device 20 are designed to mate with the slots 37 formed in the locking member arms 49.

To attach the disclosed device 20 to the locking member 30, the perimeter edge 27 of the device 20 is placed on the locking member shoulders 50 and the tabs 35 of the device 20 are positioned adjacent to the distal end of the arms 49. The device 20 is then rotated in a first direction (e.g., in FIG. 16, the device would be rotated counterclockwise). When the device is rotated, the rigid tabs 35 slightly force the distal end of the arms 49 away from the locking member body 52 to provide space for the tabs 35 to rotate past the retaining structures 51. This allows the tabs 35 to slide into engagement with the slots 37. Once the tabs 35 are positioned in the slots 37, the distal ends of the arms 49 with the retaining structures 51, snap back into their original positions, thereby locking the tabs 35 in the slots 37. In this manner, the device 20 can be securely attached to the locking member 30.

To detach the disclosed device 20 from the locking member 30, the device 20 is rotated in a second direction, which is opposite the first direction. In order to rotate the device 20 in the second direction, the user must use enough force so that the rigid tabs 35 are able to slightly force the distal end of the arms 49 away from the locking member body 52 to provide space for the tabs 35 to rotate past the retaining structures 51 and out of engagement with the slots 37. Once the tabs 35 have rotated past the retaining structures 51, the device 20 can be simply lifted off the locking member 30.

Figure 8:
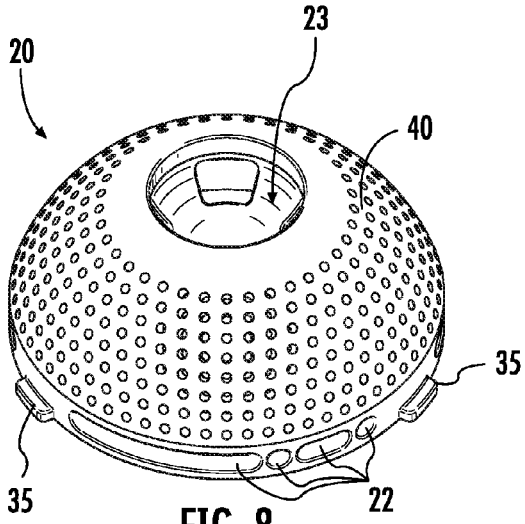
FIG. 8 is a side perspective view of the cleaning support surface of the device shown in FIG. 6.
Figure 9:
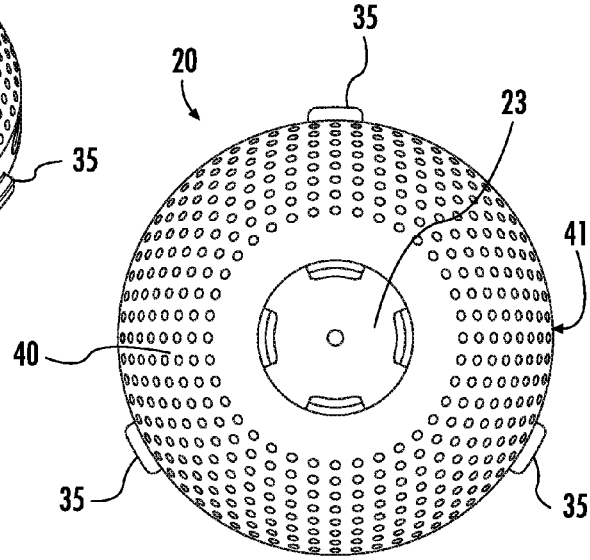
FIG. 9 is a top view of the cleaning support surface of the device shown in FIG. 6.
Figure 10:
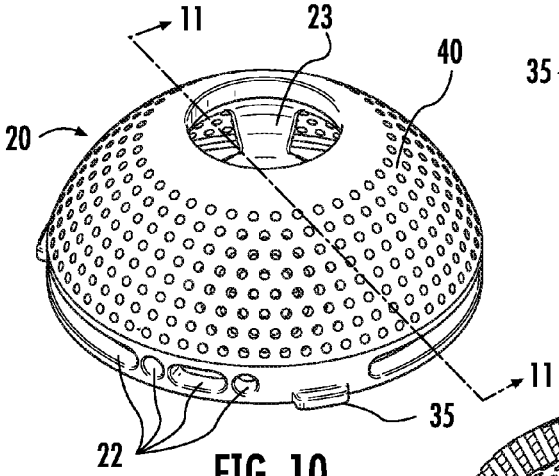
FIG. 10 is a side perspective view of the cleaning support surface of the device shown in FIG. 6.
Figure 11:
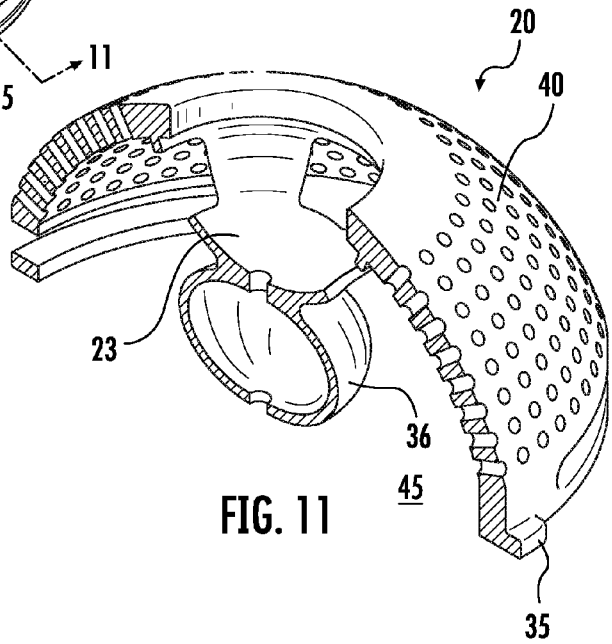
FIG. 11 is a cross-sectional view of the cleaning support surface of the device shown in FIG. 6, taken along the line 11-11 in FIG. 10.

As illustrated in FIGS. 6, 8, and 11, the perimeter edge 27 of the disclosed device 20 may include more than one type of attachment member. In these Figures, the device 20 includes attachment members defined as both tabs 35 and apertures 22 to provide the user with options in determining how to attach the device 20 to a wheel 24.

As golf cart wheel styles, attachment members, and fasteners will vary, the exact attachment mechanism will vary. The disclosed device 20 may be mounted to a wheel 24 in a permanent, semi-permanent or temporary fashion, as the user desires. Those skilled in the art will recognize that many types of fasteners, attachment members, mounting systems, and attachment mechanisms may be utilized to attach the disclosed cleaning device to a wheel, all of which are considered to be within the spirit and scope of the present invention.

The disclosed device 20 is preferably attachable to a wheel 24 of a golf cart or the like in a manner that allows rotation of the device 20 in conjunction with the rotation of the wheel 24. This feature allows the device 20 to utilize the rotational motion of the wheel 24 to provide the device 20 with greater cleaning power to better remove dirt and debris from golf equipment. Additionally, this feature saves golfers time as it allows a golfer to clean golf clubs while moving from one hole to the next, rather than requiring the golfer to stop to clean the clubs. For example, to clean a golf club head, a user can simply push a golf cart while simultaneously holding the handle of the golf club and extend the head of the club into contact with the rotating cleaning accessories on the cleaning device 20. Alternatively, an equipment support member, such as a brace, bracket, or the like, may be provided that attaches to the golf cart to assist the user in holding the club and positioning the club head against the cleaning device 20. If desired, while the golf cart is stationary, the user may clean shoes, golf balls or other equipment by rubbing the equipment against the cleaning accessories on the device 20.

The wheel 24 shown in FIGS. 4 and 5 has a hub 48 and three spokes 26 radiating from the hub 48. A variety of wheels are used on golf carts including wheels having thin wire spokes, wheels having wide plastic or metal spokes, etc. Wire spokes can be mounted radially to the hub 48 but more often are mounted tangentially to the hub 48. The disclosed device 20 is attachable to any such wheels using the disclosed attachment mechanisms.

The wheeled golf cart shown in FIGS. 4 and 5 is a manual, push/pull type of golf cart with three wheels. The disclosed device 20, however, may be adapted for use with any type of wheeled golf cart, including any push/pull type of cart or any motorized golf cart, such as a cart in which a user can sit and ride in the cart. The device 20 can be adapted in terms of size and mounting accessories to best accommodate the type of wheeled device utilized by the golfer.

Using the disclosed attachment mechanisms, the disclosed cleaning device 20 is easily detachable from a wheel 24 for hand-held use, cleaning, storage, maintenance or other purposes. As illustrated in FIGS. 6, 11, and 13, the disclosed device 20 may further include a handle 36 to provide for hand-held use of the device 20 and to make carrying the device more convenient when the device is removed from a wheel for cleaning, storage, maintenance or other purposes. The attached Figures show one embodiment of a handle 36 that may be used with the disclosed device 20. The handle 36 is preferably disposed in the hollow interior of said cleaning support surface 40, such that the handle 36 is not visible or accessible when the device 20 is attached to a wheel 24. When the device 20 is detached from a wheel 24, the handle 36 is easily accessible to the user and provides the user with a convenient hand-held cleaning device 20. One skilled in the art can appreciate that the handle 36 can be configured in numerous ways, all of which are considered to be within the spirit and scope of the present invention.

It is important to note that the construction and arrangement of the elements of the device provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes and proportions of the various components, etc.) without materially departing from the novel teachings and advantages of the invention.

Though the disclosed device is illustrated in the accompanying Figures with its application for use with golf equipment and wheeled golf carts, note that it is not intended to limit the spirit and scope of the present invention solely for use in conjunction with golf equipment and wheeled golf carts. The disclosed device may be used in a wide range of applications wherein a user wants to remove dirt or debris from an accessory or equipment including attaching the disclosed device to strollers, tricycles, bicycles, shopping carts, and the like.

Many other uses of the present invention will become obvious to one skilled in the art upon acquiring a thorough understanding of the present invention. Once given the above disclosures, many other features, modifications and variations will become apparent to the skilled artisan in view of the teachings set forth herein. Such other features, modifications and variations are, therefore, considered to be a part of this invention, the scope of which is to be determined by the following claims.

The invention claimed is:

1. A cleaning device for attachment to a wheel having a rim, said cleaning device comprising:

a cleaning support surface, said cleaning support surface being substantially bowl-shaped, having a front surface and an opening in place of a rear surface;

one or more cleaning accessories attached to an exterior surface of said front surface of said cleaning support surface, said cleaning accessories being defined as accessories used for cleaning;

a perimeter edge formed along a bottom edge of said cleaning support surface; and one or more attachment members configured for attaching said perimeter edge of said cleaning device to an inner rim surface of said wheel.

2. The device according to claim 1, wherein said cleaning support surface further comprises a recessed top surface for attachment of said one or more cleaning accessories.

3. The device according to claim 1, wherein said cleaning support surface further comprises a flat top surface for attachment of said one or more cleaning accessories.

4. The device according to claim 1, wherein said cleaning support surface is configured in the shape of a hemisphere and said perimeter edge has a circular configuration.

5. The device according to claim 1, wherein said cleaning support surface is configured in the shape of a modified hemisphere, having a top surface and side surfaces, and wherein said perimeter edge has a circular configuration.

6. The device according to claim 5, further comprising a liquid housed below said top surface.

7. The device according to claim 1, wherein said cleaning support surface is configured in the shape of a funnel.

8. The device according to claim 1, wherein at least one of said one or more cleaning accessories consists of a brush, bristles, thermoplastic nubs, a sponge, a pad, a foam accessory, a mesh accessory, or a towel.

9. The device according to claim 1, wherein at least one of said one or more cleaning accessories is defined as a plurality of bristles projecting from said cleaning support surface and forming a dome shape.

10. The device according to claim 1, wherein said one or more attachment members are defined as one or more apertures formed through said perimeter edge, and wherein said apertures are configured for receiving fasteners therethrough for attaching said device to said wheel.

11. The device according to claim 1, wherein said one or more attachment members are defined as one or more tabs extending from said perimeter edge.

12. The device according to claim 1, wherein said one or more attachment members are defined as one or more tabs and one or more apertures formed in said perimeter edge.

13. The device according to claim 1, further comprising a mounting system for attaching said device to said wheel, wherein said mounting system includes a locking member attachable to a mounting member.

14. The device according to claim 13, wherein said mounting member further comprises one or more padded members disposed between said mounting member and said wheel upon attachment of said mounting member to said wheel.

15. The device according to claim 13, wherein said locking member further comprises one or more padded members disposed between said locking member and said wheel upon attachment of said locking member to said wheel.

16. The device according to claim 13, further comprising one or more fasteners for coupling said mounting member and said locking member to said wheel.

17. The device according to claim 13, wherein said locking member further includes:

a body;

one or more shoulders extending from said body; and an arm attached to each of said one or more shoulders.

18. The device according to claim 17, wherein said arm further includes a slot and a retaining structure, said retaining structure being located on a distal end of said arm.

19. A method for attaching the device according to claim 18 to said mounting system, comprising the steps of:

placing said perimeter edge of said device on said locking member shoulders;

positioning said one or more attachment members of said device adjacent to said distal ends of said arms; and rotating said device in a first direction until said one or more attachment members slide into engagement with said slots.

20. The method according to claim 19, for detaching said device from said mounting system, further comprising the steps of:

rotating said device in a second direction, said second direction being opposite of said first direction, to disengage said one or more attachment members from said slots; and lifting said device off said locking member.

21. The device according to claim 1, wherein said device rotates in conjunction with the rotation of said wheel when said device is attached to said wheel.

22. The device according to claim 1, wherein said wheel is mounted on a golf cart.

23. The device according to claim 1, further including a handle disposed in a hollow interior of said cleaning support surface.

* * * * *